US007620333B2

(12) United States Patent
Swantner et al.

(10) Patent No.: US 7,620,333 B2
(45) Date of Patent: Nov. 17, 2009

(54) SYSTEM AND METHOD FOR PROVIDING MESSAGES ON A PRINTING COMPONENT

(75) Inventors: Richard L. Swantner, Boise, ID (US); Scott K. Hymas, Meridian, ID (US); Sarah E. Swantner, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 145 days.

(21) Appl. No.: 11/861,541

(22) Filed: Sep. 26, 2007

(65) Prior Publication Data

US 2009/0080911 A1 Mar. 26, 2009

(51) Int. Cl.
*G03G 15/00* (2006.01)

(52) U.S. Cl. ..... 399/24; 399/25; 399/26; 399/158

(58) Field of Classification Search ..... 399/24–26, 399/158

See application file for complete search history.

(56) References Cited

U.S. PATENT DOCUMENTS

| | | | | |
|---|---|---|---|---|
| 4,771,313 | A | 9/1988 | Kuroda et al. | |
| 5,021,828 | A | 6/1991 | Yamaguchi et al. | |
| 5,506,943 | A | 4/1996 | Furukawa | |
| 5,572,292 | A | 11/1996 | Chatani et al. | |
| 5,758,224 | A | 5/1998 | Binder et al. | |
| 5,995,774 | A | 11/1999 | Applegate et al. | |
| 6,332,062 | B1 | 12/2001 | Phillips et al. | |
| 6,532,346 | B2 | 3/2003 | Gallivan | |
| 7,031,012 | B1 | 4/2006 | Serizawa | |
| 2005/0286070 | A1 | 12/2005 | Kurz et al. | |
| 2006/0104655 | A1 * | 5/2006 | Learmonth et al. | 399/75 |

FOREIGN PATENT DOCUMENTS

| | | | |
|---|---|---|---|
| GB | 2389196 | | 12/2003 |
| JP | 64-007056 | A | 1/1989 |
| JP | 07234578 | | 9/1995 |
| JP | 2000181306 | | 6/2000 |
| JP | 2006-133494 | A | 5/2006 |

OTHER PUBLICATIONS

International Search Report mailed on Apr. 21, 2009 for International Application No. PCT/US2008/077385, filing date Sep. 23, 2008.

* cited by examiner

*Primary Examiner*—David M Gray
*Assistant Examiner*—Barnabas T Fekete

(57) ABSTRACT

A consumable printing component for use in a printing device includes an imaging member and a memory storing message data. In response to a trigger event, a message is formed on the imaging member at the end of a print job such that the message remains on the imaging member.

20 Claims, 5 Drawing Sheets

SYSTEM AND METHOD FOR PROVIDING MESSAGES ON A PRINTING COMPONENT

BACKGROUND

Most types of printing devices are equipped with replaceable components that have a limited operational life during which the replaceable components are functional. Such replaceable components include toner cartridges, fusers, drums, etc. At the end of the operational life of a replaceable component, the component must be replaced for the printing device to continue to function properly. For example, a toner cartridge is installed in a laser printer to provide toner for the printing process. As documents are printed, the toner supply is gradually depleted. When the toner supply is exhausted, the printer cannot print any further documents until the toner cartridge is replaced.

Occasionally, a user of the printing device believes the replaceable component is not working properly. For example, a toner cartridge may fail to print an acceptable image, or may fail to print entirely. In such instances, the user may return the replaceable component to the manufacturer, the retailer, or a service center for service or replacement under warranty. While some replaceable components returned under warranty are in fact not working properly and should be replaced or serviced, many of the returned components have in fact reached the end of their service life and are no longer covered by warranty. For example, some users are not aware that they have completely depleted the toner in a cartridge and mistakenly return the toner cartridge as defective. In other instances, fraudulent returns occur.

It is often difficult for personnel handling product returns to accurately determine whether a returned component has reached the end of its life, and whether the component is still under warranty. However, in the interest of satisfying the user and providing a positive customer experience, most returned components are replaced without ever determining whether the life of the component has expired. Consequently, many replaceable components that have in fact reached the end of their service life and are no longer under warranty are unnecessarily replaced, at significant cost to the manufacturer, retailer, or service center. It would be beneficial for the user and/or the return personnel to be able to quickly and accurately identify if a replaceable component has reached the end of its life span.

BRIEF DESCRIPTION OF THE DRAWINGS

The present invention is illustrated by way of example and not limited by the figures of the accompanying drawings. The same numbers are used throughout the figures to reference like components and/or features.

DESCRIPTION

Figure 1:
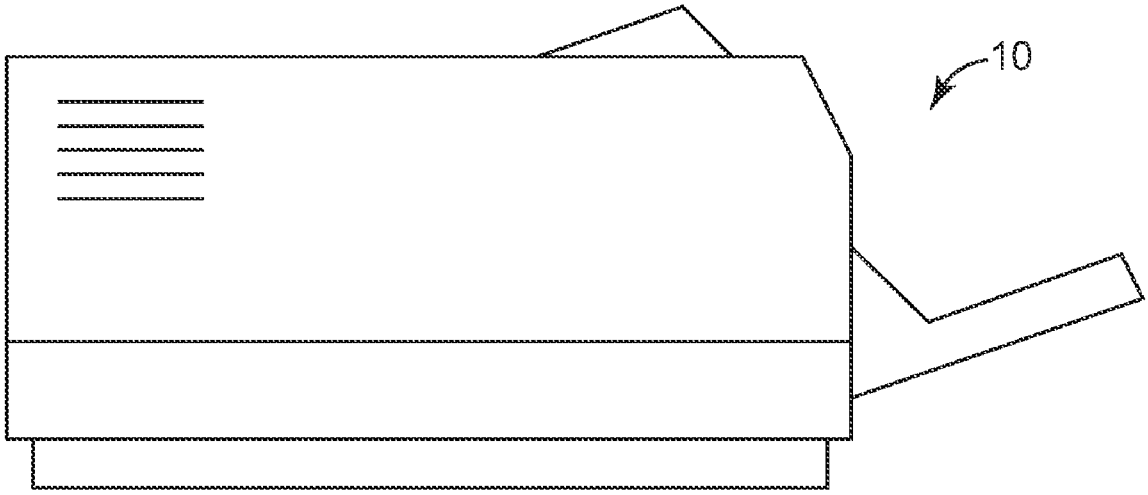
FIG. 1 is a diagrammatic illustration of a representative printing device.

FIG. 1 is a diagrammatic illustration of a representative printing device 10 in which the embodiments according to the present invention may be implemented. For purposes of illustration, the representative printing device 10 is described in the context of laser printers. However, embodiments according to the invention may also be implemented in other types of printing devices, such as photocopiers, facsimile machines, and the like.

Figure 2:
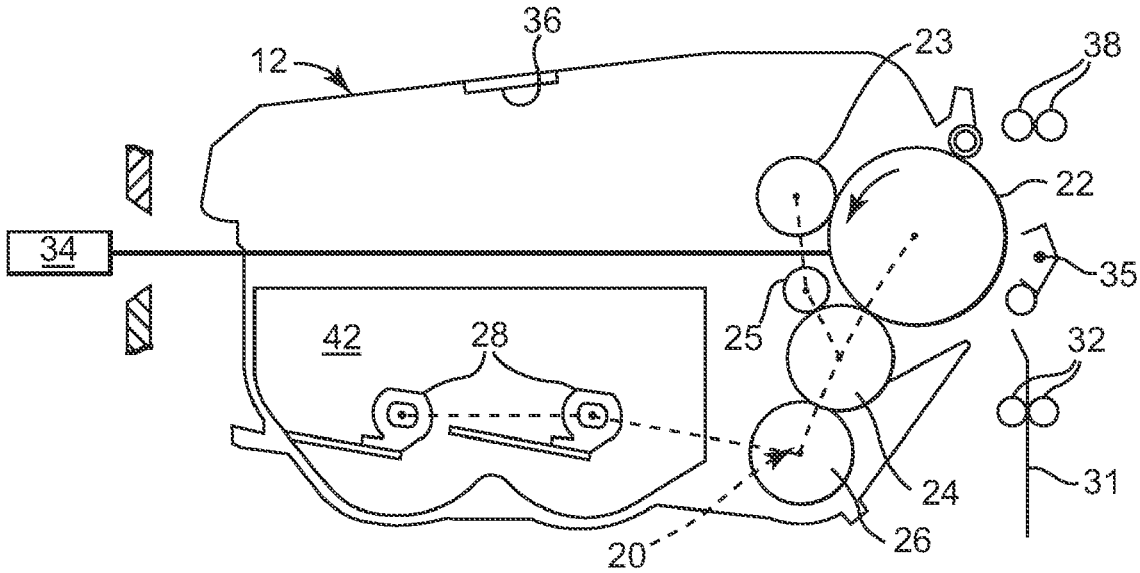
FIG. 2 is a diagrammatic illustration of a representative replaceable printing component for use in the printing device of FIG. 1.

FIG. 2 shows a representative replaceable printing component 12 that is installable in the printing device 10. Although the replaceable printing component 12 is shown and described herein embodied as a printer toner cartridge for a laser printer, it is noted that the replaceable printing component may be embodied as any replaceable printing component (i.e., a toner cartridge, print drum, etc.) installable in a printing device (printer, copier, fax machine, etc.).

Replaceable printing component 12 includes one or more moveable elements rotatably driven via a gear train 20 during a printing operation. The replaceable printing component 12 of FIG. 2 includes a photoconductive (PC) drum 22, a charge roller 23, a developer roller 24, a toner charge roller 25, a toner feed roller 26, and mixing paddles 28. Mixing paddles 28 are positioned within a toner supply reservoir 42 in which toner is contained for delivery to the surface of photoconductive drum 22 via toner feed roller 26 and developer roller 24. Print media such as a sheet of paper 31 is delivered via a plurality of supply rollers 32 against photoconductor drum 22 where an image is transferred from drum 22 to paper 31.

According to one construction, photoconductive (PC) drum 22 is an organic photoconductive (OPC) drum. However, it is understood that other forms of photoconductor drums can be utilized. For example, a photoconductive belt may be used in place of drum 22. It is further understood that other embodiments of replaceable printing component 12 may have other arrangements of rollers, gear trains, toner supply mechanisms, and the like. Replaceable printing component 12 may comprise either a color printing component, or a black and white printing component.

In operation, printing device 10 performs a complete cycle of image-forming operations with each complete revolution of photoconductive drum 22. Beginning with a process initiation point (not shown) on drum 22, a charging device such as charge roller 23 electrostatically charges the photoconductive drum 22. Subsequently, an exposure device 34, such as a solid state laser and an imaging optics array, exposes the photoconductive drum 22 with an image light pattern. Exposure of the photoconductive drum 22 results in selective discharge of the previously uniformly charged area created in the previous step, resulting in an electrostatic latent image on photoconductive drum 22. Electrostatically charged toner particles (black and/or colored) are delivered by toner feed roller 26 and developer roller 24 to the photoconductive surface on drum 22. Developer roller 24 is electrically biased so as to repel the charged toner onto the latent image on photoconductive drum 22. In this manner, toner is transferred onto photoconductive drum 22 so as to form a pattern thereon which duplicates a latent image formed by exposure device 34. A charging device 35, such as an electrically biased roller or discharge corona, charges the back side of paper 31 such that toner is transferred from the photoconductive drum 22 onto paper 31, where paper 31 and photoconductive drum 22 contact each other in the region of charging corona 35. Subsequently, a fusing station comprising a pair of hot fusing rollers 38 thermally fuses the transferred powder toner onto paper 31. In some printing devices, an intermediate transfer roller may be used to transfer the toner image from drum 22 to paper 31. Those members of replaceable printing component 12 that receive or transfer a toner image are referred to herein as "imaging members."

A memory device 36 is located on the replaceable printing component 12 and may be placed at any location on or within the replaceable printing component which may be practical for the purposes described herein. Memory device 36 may be any type of memory device known in the art. In the illustrated embodiment, the memory device 36 is a radio frequency identification (RFID) memory device. RFID memory devices and applications therefor are well known in the art. However, it is noted that the memory device 36 may be a conventional semiconductor memory and may communicate with printing device 10 via conventional electrical connections. Further aspects of the memory device 36 structure and its functionality in the present invention will become clearer as the discussion progresses.

Figure 3:
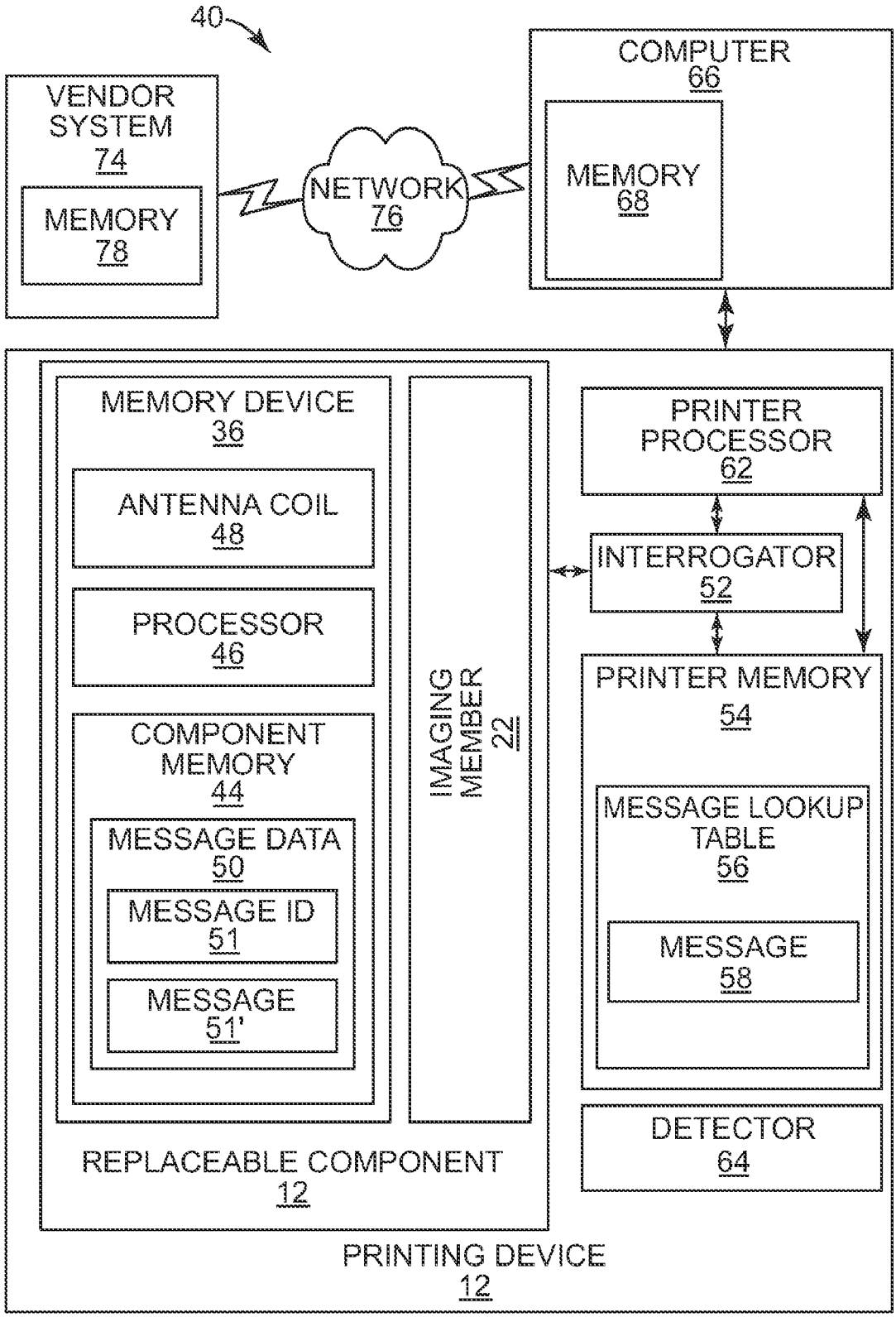
FIG. 3 is a block diagram of a printing system according to one embodiment of the invention.

FIG. 3 is a block diagram of a printing system 40 that includes the printing device 10 which has the replaceable printing component 12 installed therein, and which may be removed and replaced by another replaceable printing component (not shown). The replaceable printing component 12 includes the memory device 36 and at least one imaging member (such as photoconductive drum 22).

As previously stated, in one embodiment the memory device 36 is an RFID memory device. The RFID memory device 36 has component memory 44, a processor 46, and an antenna coil 48. The component memory 44 has message data 50 stored therein. Message data 50 may comprise one or more message identifiers 51 and/or one or more messages 51'. If the component memory 44 is of sufficient size to contain the complete electronic representation of the message(s) to be conveyed to a user, no message identifiers 51 may be needed, as the complete messages 51' may be contained in component memory 44. The format and function of the message data 50 will be described in further detail below.

The RFID memory device 36 is designed to operate in conjunction with an interrogating device, also known as an interrogator. An interrogator is a device that provides power to, reads from and/or writes to the memory device 36. Examples of interrogators include a memory device reader or scanner, a memory device writing device which stores data on the memory device 36, and the like. In the present example, the printing device 10 includes an interrogator 52.

The interrogator 52 emits a radio frequency field that provides power to the memory device 36 via the antenna coil 48. The memory device 36, therefore, does not require its own power supply, a feature that adds to the cost efficiency and practicality of utilizing RFID memory for the memory device 36.

Communications between the interrogator 52 and the RFID memory device 36 are transmitted and received via the radio frequency field and the antenna coil 48 utilizing standard RFID method and protocol, such as promulgated in ISO 14443 and ISO 15693. Therefore, physical contact between the memory device 36 and the printing device 10 is not required for the printing device 10 to communicate with the memory device 36.

The memory device 36 of replaceable printing component 12 communicates with the printing device 10, which includes printer memory 54. In one embodiment, the printer memory 54 contains a message lookup table 56 that contains messages 58. In one embodiment, messages 58 are those messages too large to be contained in component memory 44. As will be discussed in greater detail below, user messages 58 correspond to the message identifiers 51 of message data 50.

The printing device 10 also comprises a printer processor 62 and a detector 64. Detector 64 is located in the printing device 10 and is configured to detect the occurrence of one or more trigger events that occur with the replaceable printing component 12. The detector 64 is also configured to correlate a message identifier 51 from message data 50 with a message 58 in look-up table 56 of printer memory 54.

A trigger event may be any event predefined by the manufacturer that can be detected by the printing device 10. For example, trigger events may include: near or complete depletion of toner from a replaceable component; the time elapsed since the replaceable component was installed (e.g., 90 days after the replaceable printing component 12 is installed); the time elapsed since the replaceable component was manufactured (e.g., 1 year after the replaceable printing component 12 is manufactured); or the number of pages printed utilizing the replaceable component. (e.g., 1000 pages after the replaceable printing component 12 is installed).

The messages 51', 58 may include any message desired to be conveyed to a user upon the occurrence of a trigger event. Messages 51', 58 may, for example, comprise replaceable printing component 12 life status messages (e.g., "low toner," "out of toner," etc.), warranty status messages (e.g., "out of warranty"), marketing messages (e.g., "Thank you for purchasing genuine Hewlett-Packard products"), re-order information messages (e.g., "Call 555-123-4567 for replacement cartridges"), return messages (e.g., "Mail empty cartridges to PO Box 123, Anytown, USA"), or any combination thereof ("Toner Level Low—Please contact Hewlett-Packard at 555-123-4567 to order a new toner Cartridge").

The printing device 10 is connected to a computer 66 which includes memory 68. In one embodiment, the memory 68 of the computer 66 may contain the message lookup table 56.

In one embodiment, the printing device 10, via computer 66, is connected to a vendor system 74 via a network 76, such as the Internet, a local area network (LAN), a wide area network (WAN), or the like. The vendor system 74 comprises memory 78, which may contain the message lookup table 56. Maintaining lookup table 56 and messages 58 on the vendor system 74 allows the vendor to maintain control over the content of the messages 58, and allows the vendor to alter messages 58 at any time.

It is noted that although the functional components of the printing system 40 are shown in specific locations, the functional components may alternatively be located on the printing device 10, the replaceable printing component 12, the computer 66, or the vendor system 74 provided the functionality of the printing system 40 is preserved.

Figure 4:
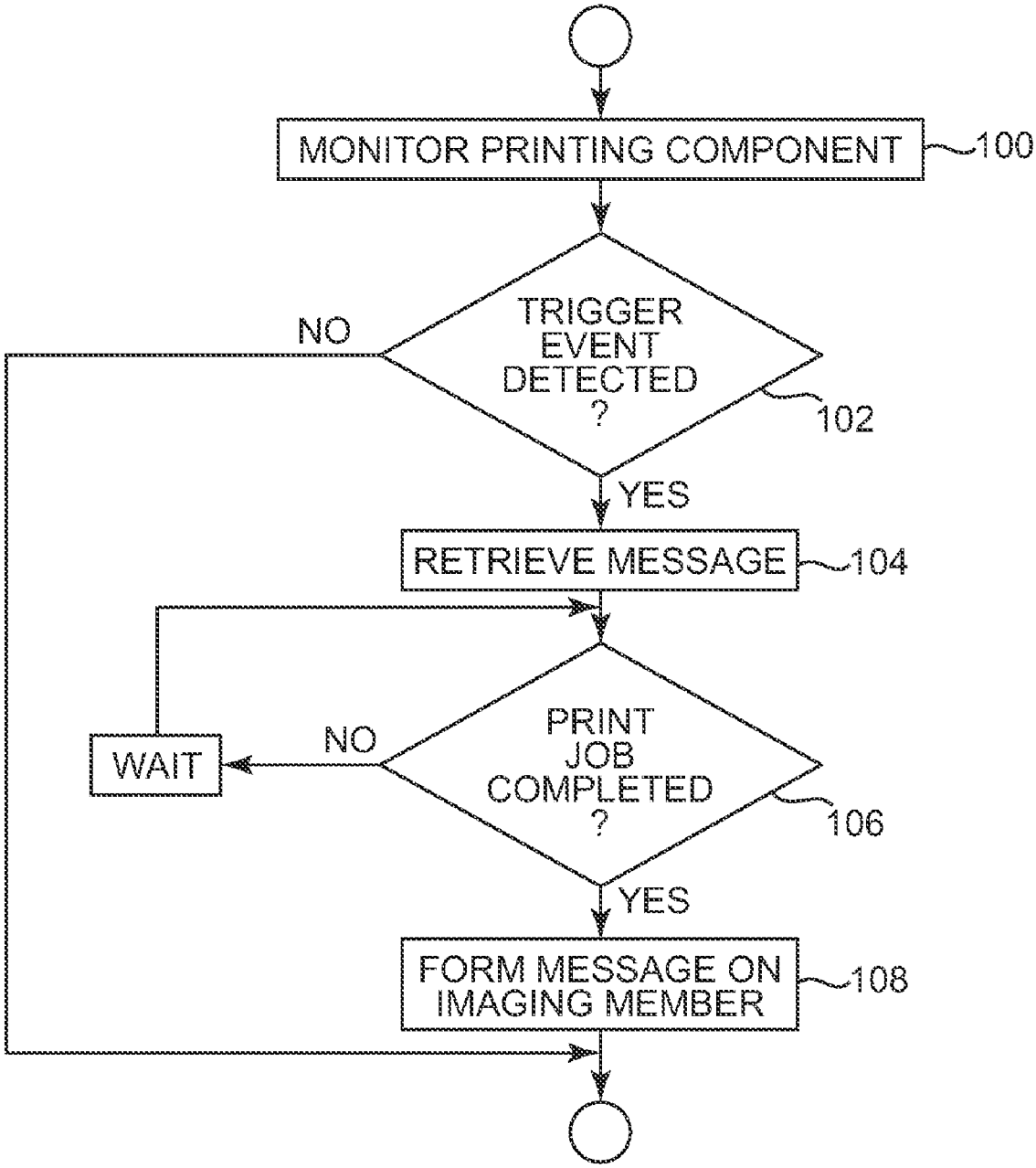
FIG. 4 is a flow diagram of a process implementing one embodiment according to the invention.

FIG. 4 depicts a flow diagram of a process implementing one embodiment according to the invention. At step 100, the detector 64 monitors the replaceable printing component 12 for an occurrence of a trigger event. In one implementation, the trigger event is the depletion of toner from replaceable printing component 12.

As shown at step 102, when the trigger event is detected, the detector 64 is configured to retrieve the message data 50 that corresponds to the trigger event (step 104). As described above, the message data 50 may be one or more message identifiers 51 and/or one or more messages 51'. If message data 50 includes message identifier(s) 51, the corresponding message(s) 58 are retrieved from message look-up table 56. If message data 50 includes only message(s) 51', it is not necessary to utilize message look-up table 56. It is noted that if the message lookup table 56 is contained in the memory 68 of the computer 66 connected to the printer 10, the process is similar to that described above, except that the printer 10 communicates with the computer to retrieve the user messages 58. Similarly, if the message lookup table 56 is contained in the memory 78 of the vendor system 74, the printer communicates with the vendor system to access the user messages 58.

Once message(s) 51' and/or message(s) 58 are retrieved in response to the trigger event, printer processor 62 determines when the current print job has been completed-(step 106). When the current print job ended has been completed, the message(s) 51' and/or message(s) 58 are formed on one or more imaging members of replaceable printing component 12 (step 108). It will be recognized that in other embodiments according to the invention, message(s) 51' and/or message(s) 58 may be retrieved after the current print job has been completed.

In the exemplary embodiment where replaceable printing component comprises a laser printer toner cartridge, exposure device 34 exposes the photoconductive drum 22 to form a latent electrostatic image of the message(s) 51' and/or message(s) 58 on photoconductor drum 22. Toner particles are delivered to the photoconductive surface on photoconductor drum 22 so as to develop the image of message(s) 51' and/or message(s) 58. However, the developed image of message(s) 51' and/or message(s) 58 is not transferred to print media such as paper 31. That is, the message(s) 51', 58 remain on the imaging member, so that the developed image of message(s) 51' and/or message(s) 58 on photoconductive drum 22 may be viewed by a user upon removing the replaceable printing component 12 from printing device 10.

Figure 5:
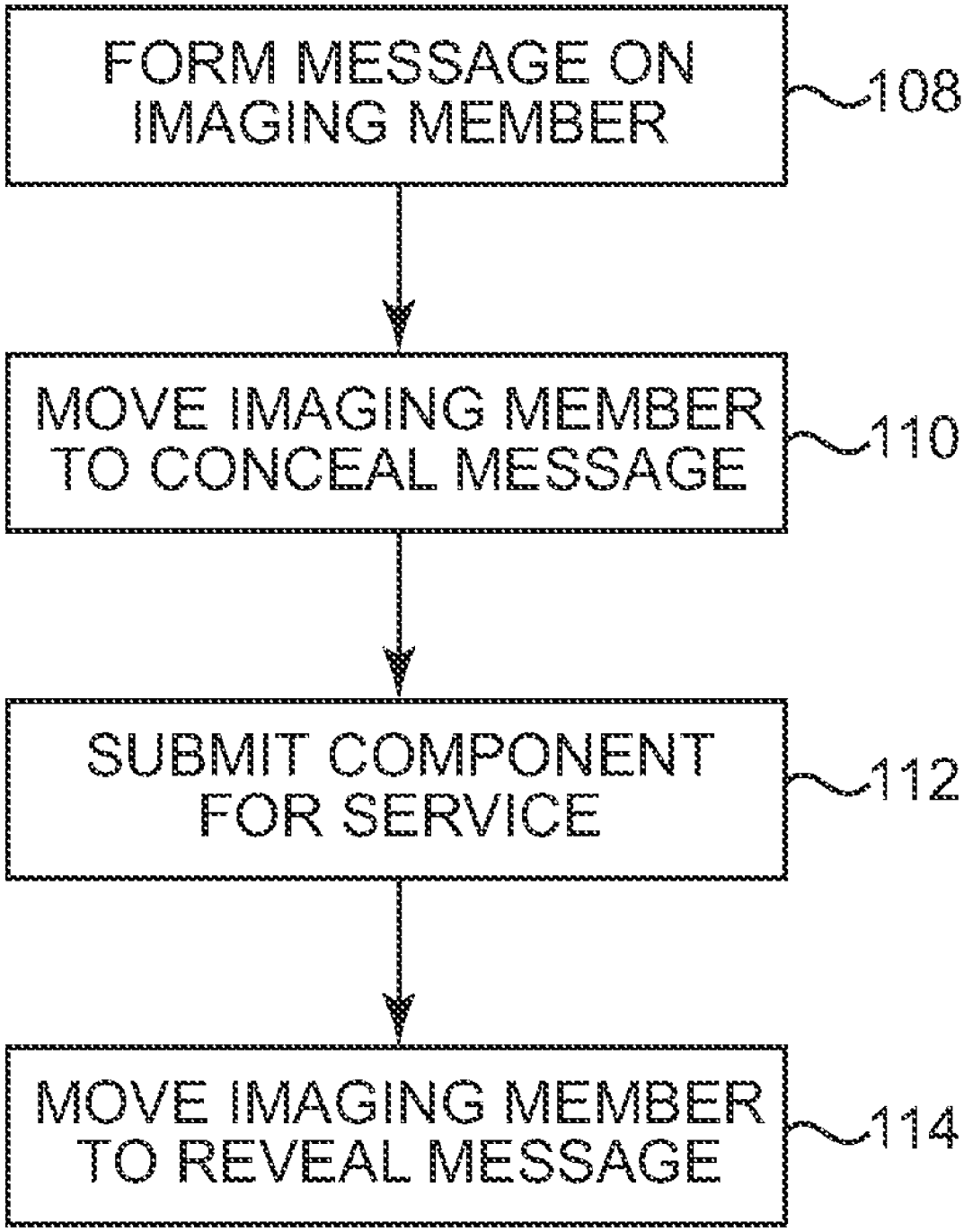
FIG. 5 is a flow diagram of a process implementing another embodiment according to the invention.

In some implementations according to the invention, it may be desired that the user cannot readily view the message(s) 51', 58 on the imaging member. For example, to assist in detecting fraudulent warranty submissions, it may be useful to conceal an "Out of Warranty" message to reduce the possibility that the message is altered or removed. In such implementations, with reference to FIG. 5, after message(s) 51', 58 are developed on the imaging member (e.g., photoconductive drum 22), the imaging member is moved or rotated such that the message(s) 51', 58 are hidden from view (step 110). When replaceable printing component 12 is returned for warranty service (step 112), personnel evaluating a warranty claim can then manually move or rotate the imaging member to a position where the message(s) 51', 58 are easily viewed (step 114).

Although the invention has been described in language specific to structural features and/or methodological steps, it is to be understood that the invention defined in the appended claims is not necessarily limited to the specific features or steps described. Rather, the specific features and steps are disclosed as representative or exemplary forms of implementing the claimed invention.

We claim:

1. In a printing device using a replaceable printing component, the replaceable printing component having an imaging member configured to transfer images to print media during a printing operation and integrated component memory, a method comprising:

detecting a trigger event;

retrieving message data from the component memory; and forming a message on the imaging member at the end of a print job such that the message is not transferred to print media and remains on the imaging member.

2. The method recited in claim 1, wherein detecting a trigger event comprises detecting an operational life status of the replaceable component.

3. The method recited in claim 2, wherein detecting an operational life status of the replaceable component comprises detecting at least one of:

(a) time elapsed since the replaceable component was installed;

(b) time elapsed since the replaceable component was manufactured; and (c) number of pages printed utilizing the replaceable component.

4. The method recited in claim 1, wherein retrieving message data from the component memory comprises:

retrieving a message identifier from the component memory; and accessing a message in a printing device memory corresponding to the message identifier.

5. The method recited in claim 1, wherein the message comprises at least one of a life status message, a warranty status message, a marketing message, a re-order information message, and a return message.

6. The method recited in claim 1, further comprising positioning the imaging member such that the message is visible to a user upon removing the replaceable printing component from the printing device.

7. The method recited in claim 1, further comprising positioning the imaging member such that the message is not visible to a user upon removing the replaceable printing component from the printing device.

8. The method recited in claim 1, wherein the message remains on the imaging member upon removing the replaceable printing component from the printing device.

9. A printing system comprising:

a printing device having a memory storing a message and a replaceable printing component having an imaging member, the imaging member configured to transfer images to print media during a printing operation;

a processor configured to retrieve the message in response to a trigger event and form the message on the imaging member at the end of a print job such that the message remains on the imaging in member upon removing the replaceable printing component from the printing device.

10. The printing system recited in claim 9, wherein the imaging member is movable within the replaceable printing component.

11. The printing system recited in claim 10, wherein the processor is further configured to move the imaging member such that the message is visible to a user upon removing the replaceable printing component from the printing device.

12. The printing system recited in claim 10, wherein the processor is further configured to move the imaging member such that the message is not visible to a user upon removing the replaceable printing component from the printing device.

13. The printing system recited in claim 10, wherein the moveable imaging member is one of a roller and a belt.

14. The printing system recited in claim 9, wherein the trigger event comprises an expiring operational life of the replaceable component.

15. The printing system recited in claim 14, wherein the expiring operational life of the replaceable component comprises one of a low toner status, an out of toner status, and an out of warranty status.

16. The printing system recited in claim 9, wherein the message comprises at least one of a life status message, a warranty status message, a marketing message, a re-order information message, and a return message.

17. The printing system recited in claim 9, wherein the memory is located in the replaceable printing component.

18. A consumable cartridge for use in a printing device, the cartridge comprising:

an imaging member; and a memory storing message data;

wherein in response to a trigger event, a message corresponding to the message data is formed on the imaging member at the end of a print job such that the message remains on the imaging member, wherein the imaging member is positioned such that the message is visible to a user upon removing the cartridge from the printing device only after repositioning the imaging member within the cartridge.

19. The cartridge recited in claim 18, wherein the message comprises at least one of a cartridge life status message, a warranty status message, a marketing message, a re-order information message, and a return message.

20. The cartridge recited in claim 18, wherein the message data comprises a message identification having a corresponding message stored in memory of the printing device.

* * * * *

UNITED STATES PATENT AND TRADEMARK OFFICE

CERTIFICATE OF CORRECTION

PATENT NO. : 7,620,333 B2
APPLICATION NO. : 11/861541
DATED : November 17, 2009
INVENTOR(S) : Richard L. Swantner et al.

It is certified that error appears in the above-identified patent and that said Letters Patent is hereby corrected as shown below:

In column 6, line 32, in Claim 9, after "imaging" delete "in".

Signed and Sealed this

Ninth Day of March, 2010

David J. Kappos

David J. Kappos
*Director of the United States Patent and Trademark Office*